US011002488B2

(12) United States Patent
Schoonen

(10) Patent No.: US 11,002,488 B2
(45) Date of Patent: May 11, 2021

(54) HEAT EXCHANGER

(71) Applicant: Franke Technology and Trademark Ltd, Hergiswil (CH)

(72) Inventor: Wilhelmus Franciscus Schoonen, BA Son (NL)

(73) Assignee: Franke Technology and Trademark Ltd, Hergiswil (CH)

( * ) Notice: Subject to any disclaimer, the term of this patent is extended or adjusted under 35 U.S.C. 154(b) by 177 days.

(21) Appl. No.: 15/774,784

(22) PCT Filed: Nov. 9, 2015

(86) PCT No.: PCT/EP2015/076041
§ 371 (c)(1),
(2) Date: May 9, 2018

(87) PCT Pub. No.: WO2017/080573
PCT Pub. Date: May 18, 2017

(65) Prior Publication Data

US 2018/0328671 A1 Nov. 15, 2018

(51) Int. Cl.

| | |
|---|---|
| ***F28D 7/14*** | (2006.01) |
| ***F28D 7/00*** | (2006.01) |
| ***F28D 7/02*** | (2006.01) |
| *F28D 21/00* | (2006.01) |

(52) U.S. Cl.
CPC ..... *F28D 7/14* (2013.01); *F28D 7/005* (2013.01); *F28D 7/024* (2013.01); *F28D 2021/0071* (2013.01); *F28F 2200/00* (2013.01)

(58) Field of Classification Search
CPC ..... F28D 7/005; F28D 7/024
See application file for complete search history.

(56) References Cited

U.S. PATENT DOCUMENTS

| | | | | |
|---|---|---|---|---|
| 3,858,646 A | | 1/1975 | Naylor | |
| 4,090,554 A | * | 5/1978 | Dickinson | F22B 1/066 165/11.1 |
| 4,687,049 A | * | 8/1987 | Golben | C01B 3/0005 165/104.12 |

(Continued)

FOREIGN PATENT DOCUMENTS

| | | |
|---|---|---|
| DE | 102012204057 | 9/2013 |
| EP | 2937657 | 10/2015 |

(Continued)

*Primary Examiner* — Filip Zec
(74) *Attorney, Agent, or Firm* — Volpe Koenig

(57) ABSTRACT

A heat exchanger is disclosed, having a vessel for containing a refrigerant, the vessel having a chamber bounded by a surface of a vessel wall, the vessel including an inlet and an outlet for transport of a refrigerant into and out of the chamber. At least one tube portion is inside the chamber, to enable fluid communication into and/or out of the tube portion through a first orifice and a second orifice. This at least one tube portion has an average diameter. The chamber has a space for the refrigerant, with the space having a volume, and the at least one tube portion has an outer surface in contact with the space for the refrigerant, this surface having an area. The volume divided by a product of the area and the average diameter is smaller than or equal to a constant.

16 Claims, 7 Drawing Sheets

(56) References Cited

U.S. PATENT DOCUMENTS

| | | | | |
|---|---|---|---|---|
| 4,706,644 | A * | 11/1987 | Nakai | B60H 1/032 122/20 B |
| 5,379,832 | A * | 1/1995 | Dempsey | B21C 37/15 165/110 |
| 5,839,383 | A | 11/1998 | Stenning et al. | |
| 5,846,498 | A * | 12/1998 | Kingsley | B01J 8/22 422/227 |
| 6,695,044 | B1 * | 2/2004 | Symonds | B01J 19/249 165/166 |
| 7,401,643 | B2 * | 7/2008 | Queheillat et al. | F28D 15/0233 165/104.21 |
| 8,573,289 | B1 * | 11/2013 | Roper | F28D 15/04 165/164 |
| 9,091,488 | B2 * | 7/2015 | Postma | F28D 3/02 |
| 9,310,135 | B1 * | 4/2016 | Farber | F28D 9/0037 |
| 2005/0202206 | A1 * | 9/2005 | Wadley et al. | E04C 2/3405 428/116 |
| 2005/0217835 | A1 | 10/2005 | Amstutz et al. | |
| 2007/0102140 | A1 * | 5/2007 | Tuma et al. | H01L 23/3732 165/80.3 |

FOREIGN PATENT DOCUMENTS

| | | |
|---|---|---|
| GB | 1247580 | 9/1971 |
| GB | 2064092 | 6/1981 |
| RU | 2155696 | 9/2000 |
| UA | 76301 | 2/2006 |

* cited by examiner

HEAT EXCHANGER

FIELD OF THE INVENTION

The invention relates to a heat exchanger. More particularly, the invention relates to a heat exchanger for cooling a fluid. The invention further relates to a cooling system comprising the heat exchanger, wherein the heat exchanger has the function of an evaporator.

BACKGROUND OF THE INVENTION

A fluid cooler can be used to cool a liquid such as water, a consumable liquid such as lemonade or beer, or another fluid. Such fluid coolers are widely employed in industry, household appliances, drinking establishments, restaurants as for example fast food restaurants, catering industry, etc. The fluid refrigerated by the fluid cooler often should be dispensed, for example in a glass. In this kind of industry, it is known to use fluid coolers including a refrigerating vessel comprising a tube containing refrigerant that goes through the inside of the refrigerating vessel. In this way, a cooling liquid, such as water, can be stored inside of the refrigerating vessel; and the refrigerant that flows through the tube, can cool the water. The consumable liquid can be fed through another tube that is immersed in the cooled water. However, usually the dimensions of such kind of fluid coolers are big, therefore using a large amount of space in the establishments in which they are used. Another drawback of these fluid coolers is that they are energy inefficient.

More generally, heat exchangers are known to be used in refrigerating systems. However, there would be a need for an improved heat exchanger.

GB 1247580 discloses a refrigerating system including a compressor, a condenser, a fluid line, and a cooling unit wherein this cooling unit comprises an annular refrigerant chamber containing refrigerant.

DE 10 2012 204057 further discloses a heat exchanger comprising a cavity which is filled with refrigerant coming out of an evaporator in order to regulate the temperature of the refrigerant before sending it to the condenser.

SUMMARY OF THE INVENTION

An aspect of the invention is to provide a compact heat exchanger that is efficient and/or needs only a limited amount of refrigerant.

An aspect of the invention is to provide a heat exchanger comprising:

a vessel for containing a refrigerant, the vessel having a chamber bounded by a surface of a vessel wall, the vessel comprising an inlet and an outlet for transport of a refrigerant into and out of the chamber;

at least one tube of which at least one tube portion is inside the chamber, wherein a first end of the tube portion is fixed to a first orifice of the vessel and a second end of the tube portion is fixed to a second orifice of the vessel to enable fluid communication into and/or out of the tube portion through the first orifice and the second orifice, wherein said at least one tube portion has an average diameter;

wherein the chamber comprises a space for the refrigerant, said space having a volume, wherein the at least one tube portion has an outer surface in contact with the space for the fluid, said surface having an area;

wherein the volume divided by a product of the area and the average diameter is smaller than or equal to 0.15. This may be equal to saying that said volume, which can be filled with the refrigerant, is equal to or smaller than 0.6 times a volume defined by said tube portion.

This heat exchanger may have a relatively large capacity of heat exchange while significantly reducing the amount of refrigerant that is needed in e.g. a cooling system. The at least one tube portion inside the chamber may comprise a plurality of adjacent tube segments. Adjacent tube segments may be defined as tube segments with facing outside surfaces.

Preferably, the volume divided by a product of the area and the average diameter is smaller than or equal to 0.1. More preferably, the volume divided by a product of the area and the average diameter is smaller than or equal to 0.08. This helps to further reduce the amount of refrigerant and/or increase cooling capacity.

The at least one tube portion inside the chamber may comprise a plurality of adjacent tube segments, wherein adjacent tube segments are spaced with respect to each other with a space in between a pair of adjacent tube segments of at most 2 millimeters, preferably at most 1 millimeter, preferably at most 0.5 millimeter. This helps to reduce the amount of refrigerant and/or increase cooling capacity even more.

The at least one tube portion inside the chamber may comprise a plurality of adjacent tube segments, which adjacent tube segments form a hexagonal tiling arrangement in a cross section of the chamber. A hexagonal tiling is a suitable structure to obtain a compact heat exchanger. Alternatively, adjacent tube segments can be arranged on a rectangular grid or in another suitable form.

The plurality of adjacent tube segments of the hexagonal tiling may be arranged in rows, each row consisting of a number of windings, wherein the number of windings in any one row differs with respect to each adjacent row by one winding, wherein when considering the successive rows, the number of windings is either monotonically increasing or decreasing, or first increases and then decreases. This provides a compact outline of the arrangement of tube segments.

The at least one tube portion may be arranged in a plurality of windings around a wall portion of said vessel wall and around a region external to the chamber. This may provide a chamber with a small volume while the tube does not need to make sharp turns. This external region may form a recess, which recess penetrates the chamber and is bordered by said wall portion of the vessel wall.

The chamber may have a shape of a toroid. The toroid may be generated by a hexagon or a quadrilateral, for example. The hexagon or quadrilateral may have rounded corners following a contour of the tube.

More generally, the overall shape of the chamber can take the form of a connected, orientable surface with genus 0, 1, 2, . . . , where genus=1 defines a toroid. The genus of a connected, orientable surface is an integer representing the maximum number of cuttings along non-intersecting closed simple curves without rendering the resultant manifold disconnected. However, while the toroidal shape is preferred, the invention is not limited to a particular type of surface.

The distance between a central axis of the tube in two adjacent windings multiplied by one half of the square root of three may be smaller than an outer diameter of the tube. This defines a compact hexagonal tiling.

The distance from the surface of the vessel wall to a circumference of a first segment of the at least one tube portion adjacent to the surface may be substantially equal to a distance between that circumference and a circumference of a second segment of the at least one tube portion adjacent to the first segment.

The space for the fluid may comprise propane as the refrigerant. The compact design means that only a rather small amount of propane is necessary. Thus the proposed heat exchanger is capable of complying with severe environmental and/or safety related regulations.

The vessel may further comprise a body, and the vessel wall may be enclosed in the body, wherein the body is configured to reinforce the vessel wall in view of a pressure difference between the chamber and an environment of the heat exchanger. The body may be a toroid shaped body.

The heat exchanger may be part of a system further comprising a compressor, a condenser, and an expansion valve, wherein the compressor, the condenser, the expansion valve, and the heat exchanger are in fluid communication, wherein the inlet is fluidly connected to the expansion valve and the outlet is fluidly connected to the compressor.

According to another aspect of the invention, a method of cooling a fluid is provided. The method comprises:

providing a compressor, a condenser, an expansion valve, and an evaporator, in fluid communication to form a refrigeration cycle, wherein the evaporator comprises a heat exchanger, and the heat exchanger comprises a vessel, the vessel having a chamber bounded by a surface of a vessel wall, the vessel comprising an inlet and an outlet for transport of a refrigerant into and out of the chamber, wherein providing a compressor, a condenser, an expansion valve, and an evaporator in fluid communication comprises fluidly connecting the inlet of the vessel to the expansion valve and fluidly connecting the outlet of the vessel to the compressor;

providing at least one tube of which at least one tube portion is inside the chamber, wherein a first end of the tube portion is fixed to a first orifice of the vessel and a second end of the tube portion is fixed to a second orifice of the vessel to enable fluid communication into and/or out of the tube portion through the first orifice and the second orifice, wherein said at least one tube portion has an average diameter;

providing the chamber with a space for a fluid, said space having a volume, wherein the at least one tube portion has an outer surface in contact with the space for the fluid, said surface having an area;

wherein the volume divided by a product of the area and the average diameter is smaller than or equal to 0.15;

the method further comprising:

operating the compressor to circulate a refrigerant through the refrigeration cycle including the space for the fluid, and causing a further fluid to flow through the tube portion.

The person skilled in the art will understand that the features described above may be combined in any way deemed useful. Moreover, modifications and variations described in respect of the heat exchanger or cooling system may likewise be applied to the method, and modifications and variations described in respect of the method may likewise be applied to the heat exchanger or cooling system.

BRIEF DESCRIPTION OF THE DRAWINGS

In the following, aspects of the invention will be elucidated by means of examples, with reference to the drawings. The drawings are diagrammatic and may not be drawn to scale.

DETAILED DESCRIPTION

In the following, exemplary implementations will be described in more detail with reference to the drawings. However, it will be understood that the details described herein are only provided as examples to aid an understanding of the invention and not to limit the scope the disclosure. The skilled person will be able to find alternative embodiments which are within the scope and spirit of the present invention as defined by the appended claims and their equivalents.

Figure 1:
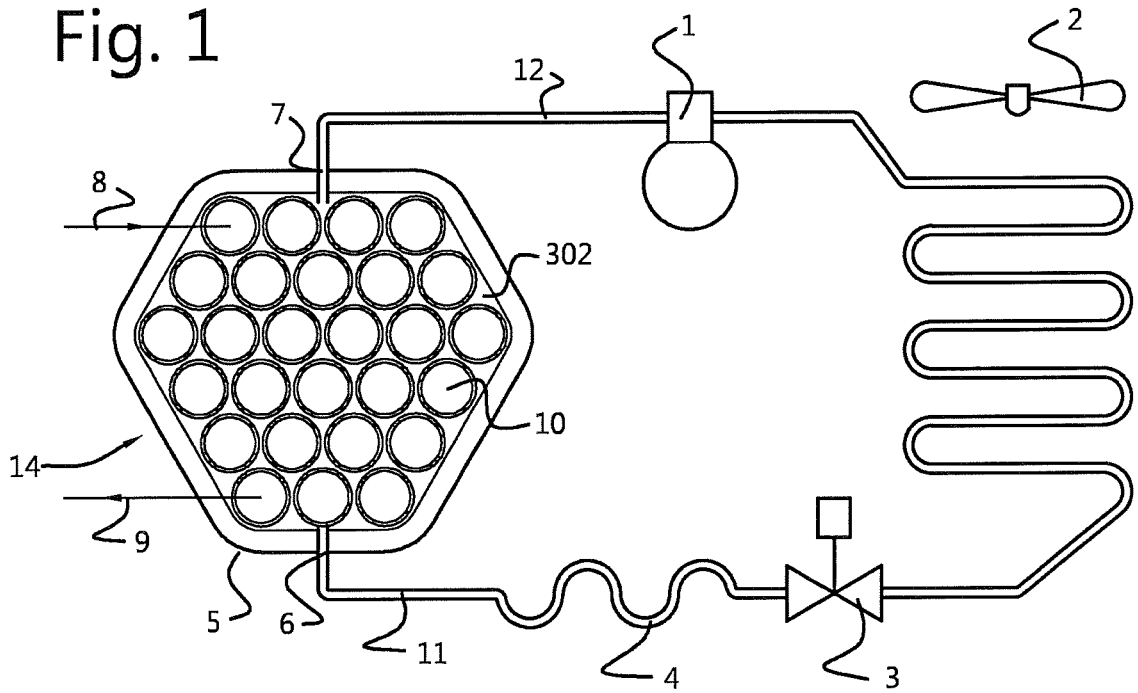
FIG. 1 shows a cooling system.

FIG. 1 shows a diagram of a cooling system capable of circulating refrigerant in a refrigeration cycle. The cooling system comprises a compressor 1, a condenser 2, a valve 3, an expansion device 4, and an evaporator 14. The evaporator is shown in cross section. The cross section corresponds to cross section 303 in FIG. 3. These components 1, 2, 3, 4, 14 are fluidly connected to form the refrigeration cycle. Many different implementations of the compressor, condenser, valve, expansion device, and evaporator are known in the art. For example, the valve 3 and the expansion device 4 may be combined by means of an expansion valve. Some aspects of the invention relate to the evaporator 5, which may be included in such a refrigeration cycle of a cooling system. In the following, the evaporator 14 will be described in greater detail. It will be noted that in FIGS. 1, 7, and 8, the compressor 1, condenser 2, valve 3, and expansion device 4 are drawn as symbols to indicate any suitable device can be used, whereas the evaporator 14 has been drawn in greater detail to illustrate aspects of certain embodiments of the evaporator 14.

As shown in FIG. 1, the evaporator 14 comprises a vessel 5 which contains a chamber 302, and the chamber 302 contains tubing 10, 301.

Figure 2:
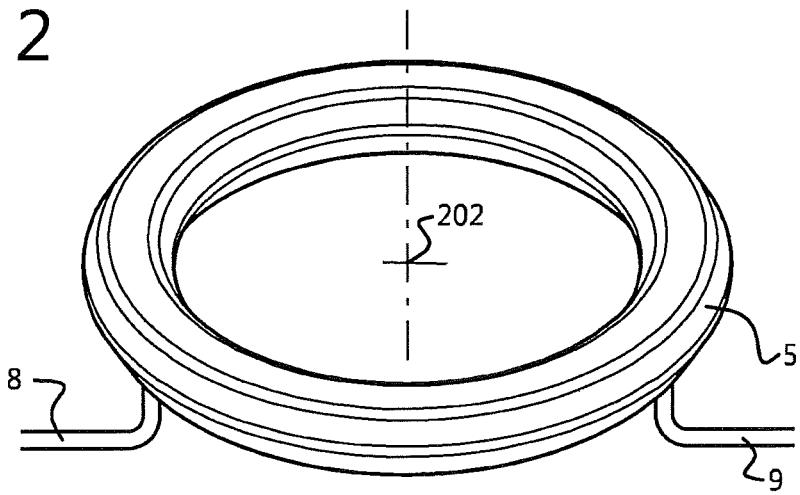
FIG. 2 shows a perspective view of a heat exchanger.
Figure 4:
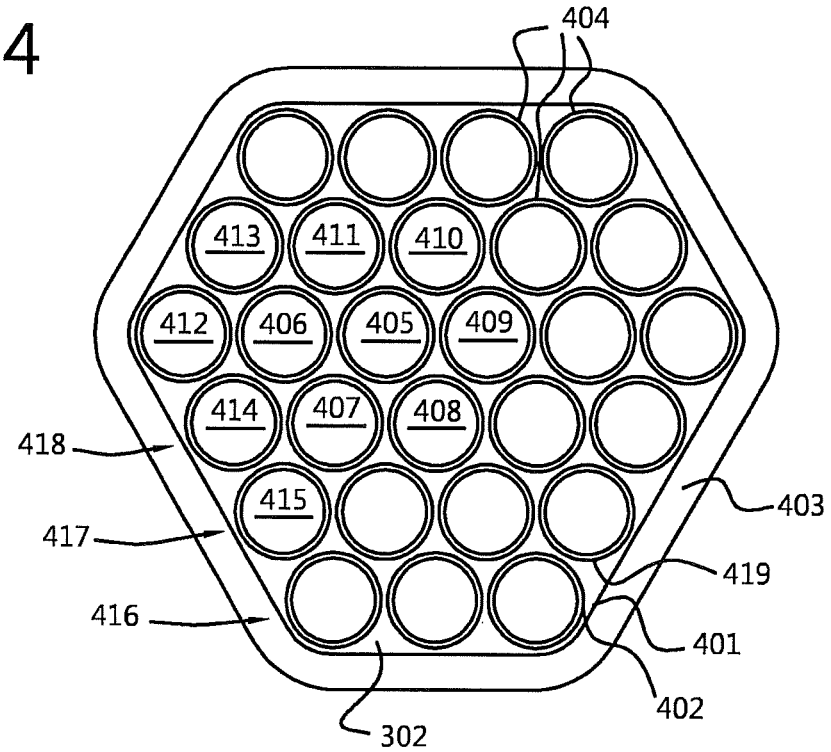
FIG. 4 shows a cross section of a part of a heat exchanger.

FIG. 2 shows a perspective view of the vessel 5, 201 that can take the role of the evaporator 14 in a refrigeration cycle. In this example, the vessel has a toroid shape. The illustrated toroid is a toroid generated by revolving a planar hexagon 401 (see FIG. 4) about an axis (loosely drawn at numeral 202) external to that hexagon 401, which axis is parallel to the plane of the hexagon 401 and does not intersect the hexagon. It will be understood that the hexagon may be replaced by other shapes. The hexagon 401 is illustrated in FIG. 4. As shown in FIG. 4, the hexagon may have rounded corners. The rounding of a corner of the hexagon 401 may follow the outline of a tube portion 402.

Figure 3:
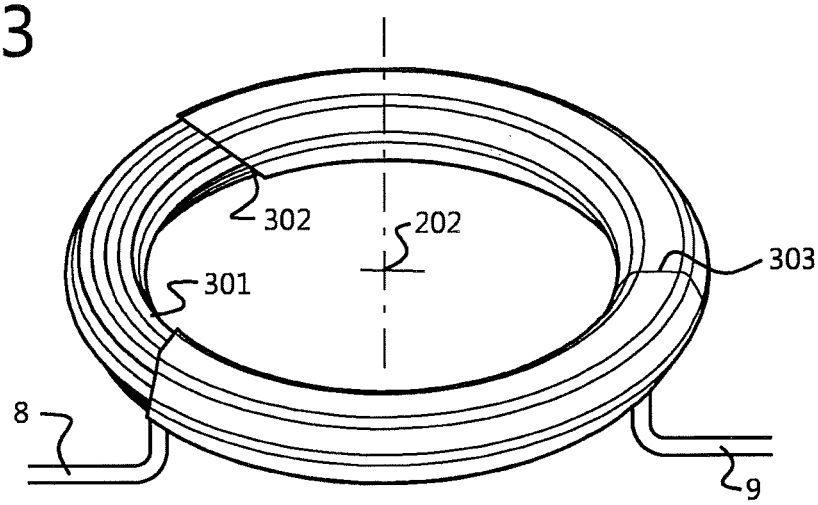
FIG. 3 shows a partially worked open view of a heat exchanger.

Shown in FIG. 2 and FIG. 3 are the tube portion 8 connected to one end of tube portion 10 to enable fluid to flow through tube portion 8 into tube portion 10. Also shown is tube portion 9, which is connected to another end of tube portion 10 to enable fluid to flow from tube portion 10 into tube portion 9. It is noted that the flow of fluid may be reversed, so that fluid flows from tube portion 9 into tube portion 10 and then into tube portion 8.

FIG. 3 shows a partially worked open drawing of the same vessel 5, 201 as shown in FIGS. 1 and 2. The chamber 302 of the shown vessel 5, 201 has a toroid shape as described above. The drawing shows that the chamber 302 of the vessel 5, 201 is densely packed with tubing 301. The tubing 301 is wound inside the chamber 302 around the above-mentioned axis 202 and thus around a recess enclosed by said chamber, which recess forms a region external of said chamber.

FIG. 4 shows again the cross section corresponding to portion 303 of the vessel 5 as shown in FIGS. 1, 2, and 3. It is noted that the tubes 12 and 11 for transport of refrigerant have not been drawn in FIGS. 2, 3, and 4 for simplicity. As can be seen from the drawing, the chamber 302 of the heat exchanger is densely packed with tube windings 404. These windings may all belong to the same tube. Alternatively, a plurality of tubes exists inside the chamber 302, and each winding belongs to one of those tubes.

In a particular example, the dimensions of the arrangement of the chamber 302 and the tube windings 404 are as follows. The tube or tubes may have an inner diameter of 7 mm, an outer diameter of 8 mm, a wall thickness of 0.5 mm. A distance between any two adjacent tube windings may be 8.5 mm, measured from center axis to center axis of the tube. The distance from the tube to the vessel wall may be 0.5 mm. The number of windings may be 27.

Figure 5:
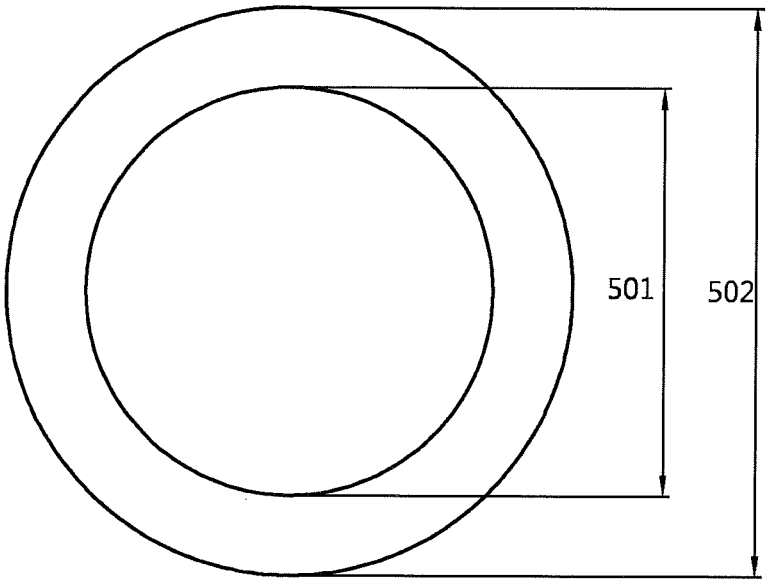
FIG. 5 shows a top view of a heat exchanger.
Figure 6:
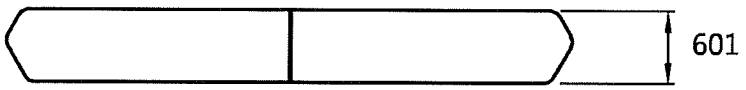
FIG. 6 shows a side view of a heat exchanger.

FIG. 5 illustrates a top view of the chamber, wherein the windings are not shown. FIG. 6 illustrates a side view of the chamber. An example of dimensions of the chamber is as follows. The smallest diameter 501 of the chamber may be 292.65 mm, and the largest diameter 502 of the chamber may be 407.35 mm. A measurement of this may be done with an accuracy of ±1 mm. A height 601 of the chamber may be 52 mm.

Returning to FIG. 1, it is schematically indicated at numerals 8 and 9 that the tube enters and exits the chamber 302 through two orifices in the vessel wall. The orifices may enclose the tube such that no refrigerant can enter or leave the chamber through the orifice, and no fluids from exterior may enter through the orifice into the chamber. Further, the vessel wall has an inlet 6 and an outlet 7 connected to tubing 11, 12 to transport the refrigerant from the expansion device into the chamber 302 and from the chamber 302 into the compressor 1. The inlet 6 is located at the bottom side of the chamber 302, or at least below a level of liquid refrigerant inside the chamber. However, the inlet 6 may also be located above the level of liquid refrigerant in other embodiments. The outlet 7 is located at the top side of the chamber 302, or at least above a level of liquid refrigerant inside the chamber. This way, no liquid refrigerant can reach the compressor.

As explained, the vessel can be used in a refrigeration cycle of a cooling system. The vessel in that state contains a refrigerant in the chamber, which refrigerant is circulated through the cooling cycle. Some of the refrigerant is in liquid state, another portion is in vapor state. The vessel has a chamber bounded by a surface of the vessel wall, the vessel comprising an inlet and an outlet for transport of refrigerant into and out of the chamber. The inlet can be anywhere; the outlet is preferably above the level of liquid refrigerant in certain embodiments. At least one tube is provided through which a liquid to be cooled is to flow in operation. At least one tube portion is inside the chamber, wherein a first end of the tube portion is fixed to a first orifice of the vessel and a second end of the tube portion is fixed to a second orifice of the vessel to enable fluid communication into and/or out of the tube portion through the first orifice and the second orifice. For example, the tube extends through the first orifice and/or second orifice. The first orifice and second orifice may be an orifice in the vessel wall and/or an orifice in a toroid shaped body which may enclose the vessel wall, as explained below. In the example shown in FIGS. 2 and 3, the chamber of the heat exchanger presents a hole 201. The tube portion inside the vessel is arranged in a plurality of windings around a wall portion of said vessel wall, which wall portion defines said hole. The hole 201 extends all the way through the vessel 5 and is defined by a wall portion of the vessel wall, so that fluids do not leak through the hole. The windings are arranged in a hexagonal tiling arrangement and form a bundle, with a space between each pair of adjacent windings. This hexagonal tiling can be best appreciated with reference to e.g. FIG. 4 which shows a cross section of the vessel at one side of the hole, as indicated in FIG. 3 at numeral 303. In other words, in a cross section perpendicular to the central axis of the tube windings or tube segments, the tubes are arranged on a hexagonal grid. The tubes may be fixed to one another to keep them in place.

The surface 403 of the vessel wall is arranged with a space between the vessel wall and all of the windings 402 that are at an outside of the bundle. The windings which are at the outside of the bundle are those windings that are surrounded by less than six adjacent windings. For example, winding 405 is surrounded by six adjacent windings 406-411 and is not at the outside of the bundle. Winding 412 is surrounded by three adjacent windings 406, 413, 414, and winding 414 is surrounded by four adjacent windings 412, 406, 407, 415.

In the example shown in FIG. 4, the hexagonally tiled windings are arranged in rows, e.g. 416, 417, 418, etc., each row 418 consisting of a number of windings 414, 407, 408, etc., wherein the number of windings in any one row 417 differs with respect to each adjacent row 416 or 418 by one winding. When considering the successive rows 416, 417, 418, etc. in turn, the number of windings first increases from three windings to six windings and then decreases to four windings.

In an alternative embodiment, the number of windings in each row monotonically increases or monotonically decreases. For example, the number of windings in a row can increase from e.g. three (bottom row) to seven (top row). In another example, the number of windings in a row can decrease from e.g. seven (bottom row) to three (top row). The rows in a hexagonal tiling can be identified in three different directions, and the increase/decrease of the number of windings in each row applies to at least one of those directions.

Returning to FIG. 4, the pattern of increasing number of windings in each row is identical for all three directions in which the rows can be identified. This property is also helpful to keep the chamber small.

The chamber 302 and the surface of the vessel wall 403 has a shape of a toroid generated by a hexagon. This hexagon has rounded corners following a contour of the tube 402, 412. When the number of windings in each row is monotonic, the shape of the chamber and surface is the shape of a toroid generated by a quadrilateral, optionally with rounded corners.

Figure 9:
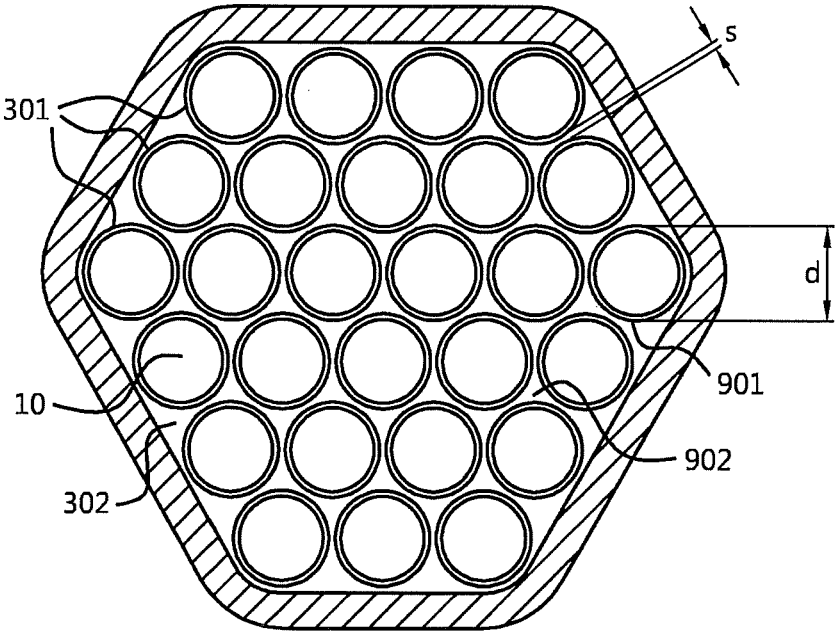
FIG. 9 shows a cross section of a part of a heat exchanger.

The distance between a central axis of the tube in two adjacent windings 410, 411 multiplied by one half of the square root of three is smaller than an outer diameter (indicated d in FIG. 9) of the tube. Referring to FIG. 9, the distance between the central axis of the tube in two adjacent windings is equal to the sum of the space (indicated s in FIG. 9) in between a pair of adjacent tube segments and the outer diameter (indicated d in FIG. 9) of the tube portion. In a specific example, the distance between a central axis of the tube in two adjacent windings is 8.5 mm, the inner diameter of the tube is 7 mm, and the outer diameter of the tube is 8 mm. The spacing of the rows 416, 417, 418 is 7.4 mm in the example, which is smaller than the distance of 8.5 mm between the central axes of adjacent windings, which makes the design compact.

The distance from the inner surface 401 to a circumference 402 of a first portion of the tube adjacent to the inner surface 401 can be about equal to a distance between that circumference and a circumference 419 of a second portion of a winding of the tube adjacent to the first portion of the tube.

The heat exchanger of claim 1, wherein the tube has an inner diameter of 7 mm, and the distance between the outlines of each pair of adjacent windings is between 0.2 and 0.8 mm.

Depending, among other parameters, on the dimensions of the heat exchanger, the heat exchanger can be used in conjunction with a variety of refrigerant materials, including Freon. In a particular example, the chamber comprises propane as the refrigerant. The dimensions described above are well suited for a cooling system based on propane as a refrigerant.

Figure 7:
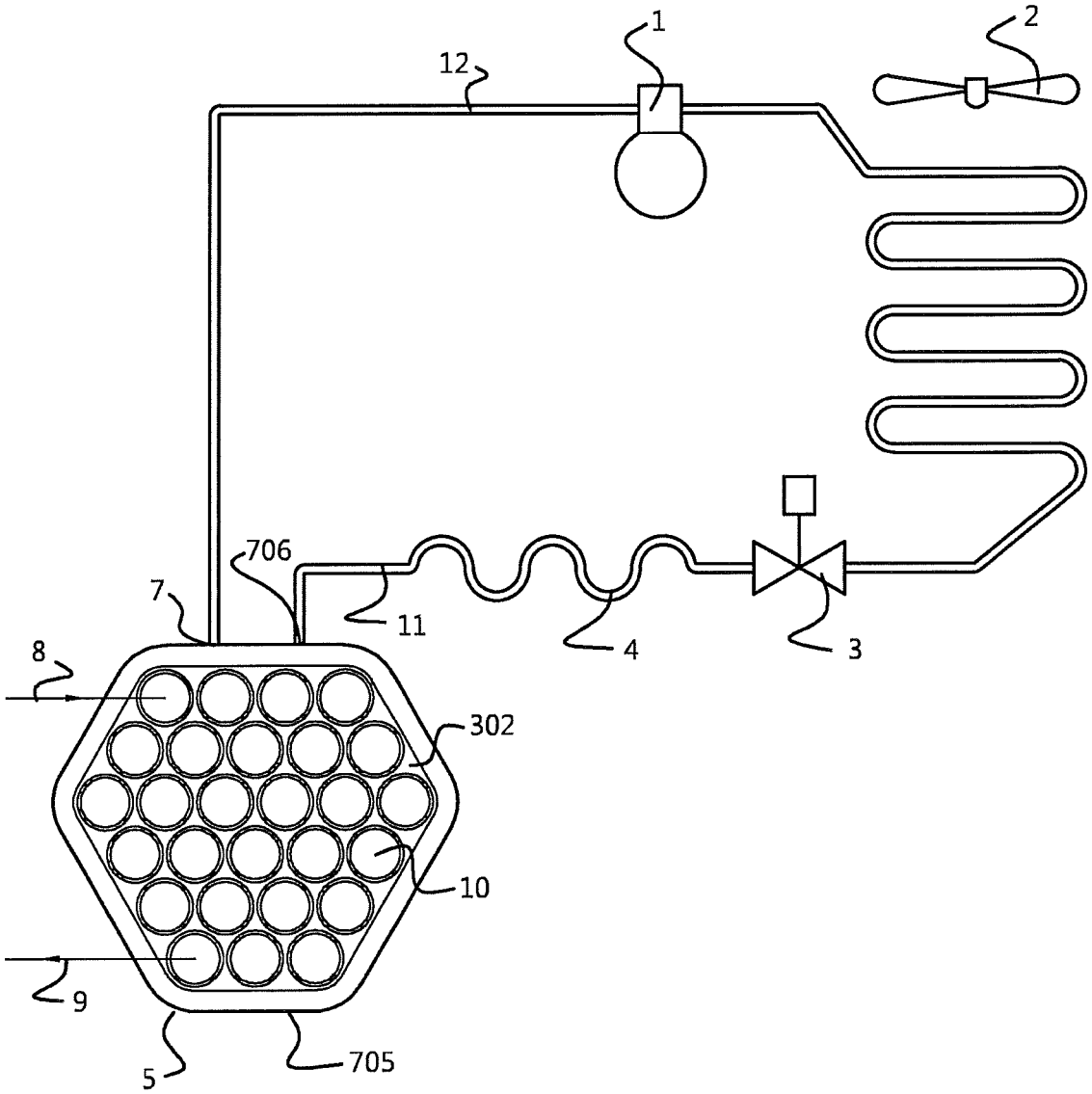
FIG. 7 shows an alternative cooling system with a partial cross section of the heat exchanger.

FIG. 7 illustrates an alternative configuration. Since most aspects of FIG. 7 are similar to the configuration of FIG. 1, a detailed description thereof will be omitted here. The configuration shown in FIG. 7 differs from the configuration shown in FIG. 1 in that the inlet 706 of the chamber 302 is located at the top side of the chamber.

Figure 8:
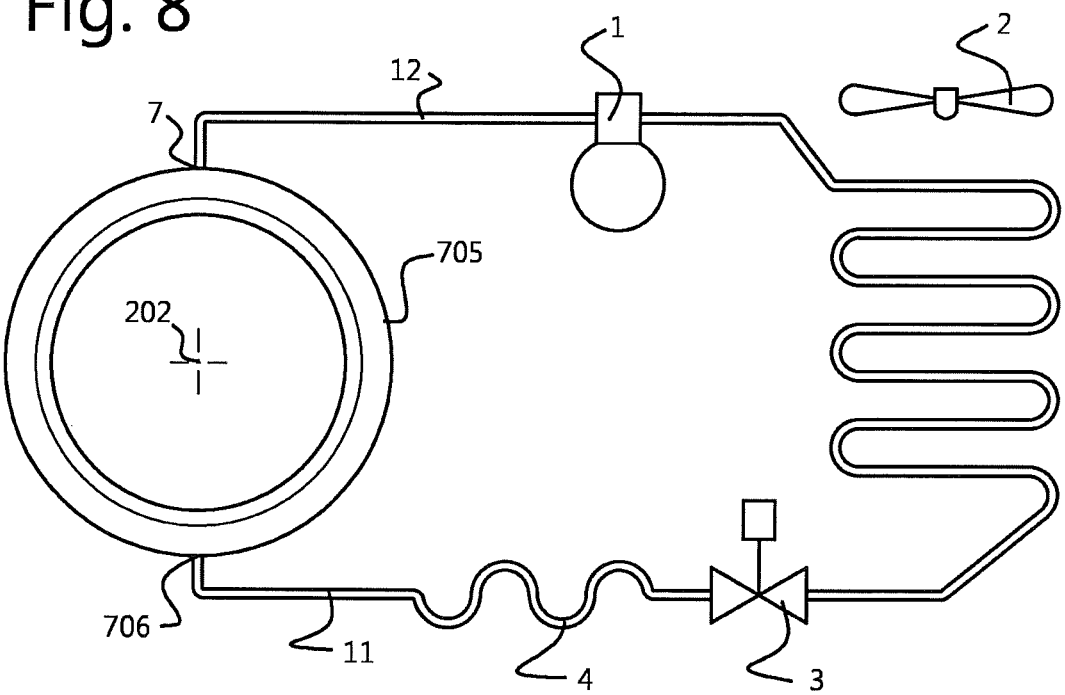
FIG. 8 shows the alternative cooling system with a top view of the heat exchanger.

FIG. 8 shows a top view of the heat exchanger shown in FIG. 7. It is shown that the inlet 706 of the chamber 302 and the outlet 7 of the chamber 302 are positioned on opposing sides with respect to the axis 202. More generally, it may be advantageous to position the inlet 706 and the outlet 7 sufficiently far away from each other that it is avoided that the refrigerant that freshly arrives through the inlet 706 is directly sucked out through the outlet 7. Such a configuration is advantageous when both the inlet and outlet are located above the level of liquid refrigerant.

For example, the length of the tube portion within the vessel is in the range of 25 meters to 35 meters. The volume of the chamber minus a volume occupied by the at least one tube portion can be, for example, in between 700 $mm^3$ and 800 $mm^3$, for example 730 $mm^3$. These dimensions can make the tube particularly suitable as a cooler for a beer tap.

Figure 10:
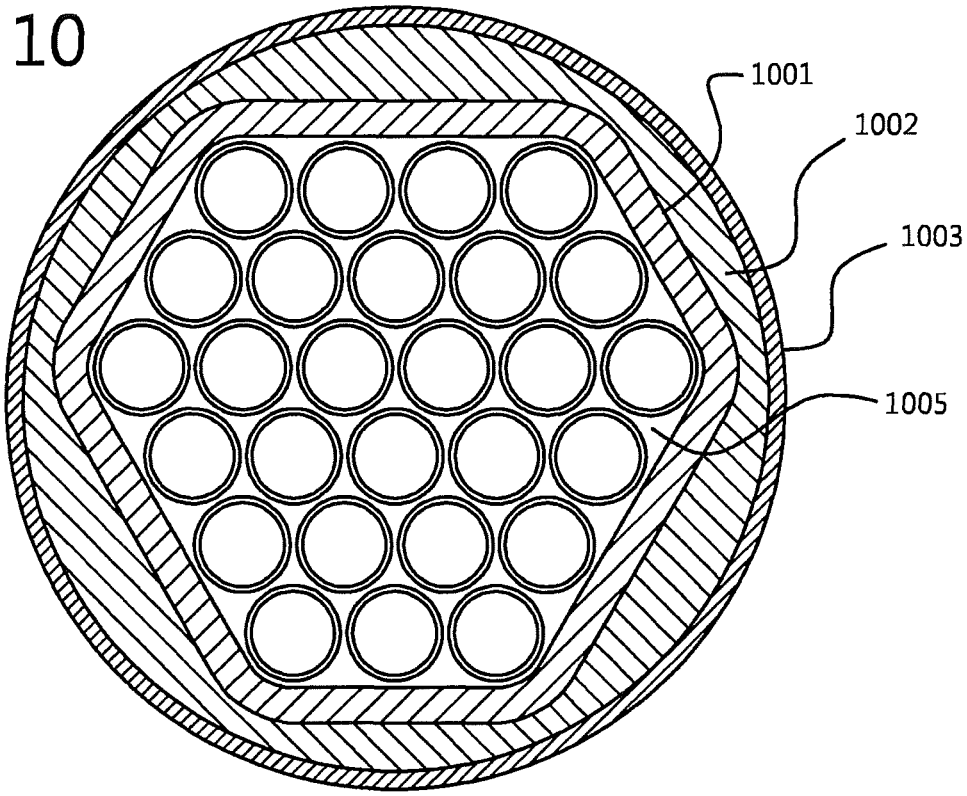
FIG. 10 shows a cross section of yet another heat exchanger.

FIG. 10 shows another embodiment of a heat exchanger. Again, only a cross section has been shown of a portion of the heat exchanger similar to portion indicated as 303 in FIG. 3. The surface 1004 of the vessel wall 1001 that defines the chamber 1005 is a closed surface, and a toroid shaped body 1003 encloses the vessel wall 1001. Optionally, filling material 1002 fills in any space between the vessel wall 1001 and the toroid shaped body 1003. Alternatively, no space or only a small space exists between the vessel wall 1001 and the toroid shaped body 1003. The toroid shaped body 1003 is toroid shaped, for example torus shaped. The vessel wall/chamber may also be toroid shaped, but for example a toroid generated by a hexagonal (as in the drawing) or quadrilateral. Due to the stronger construction of the torus 1003 and the filling material 1002, the vessel wall 1001 does not have to be so strong to absorb the pressure difference between chamber 1005 and the environment of the heat exchanger.

Figure 12:
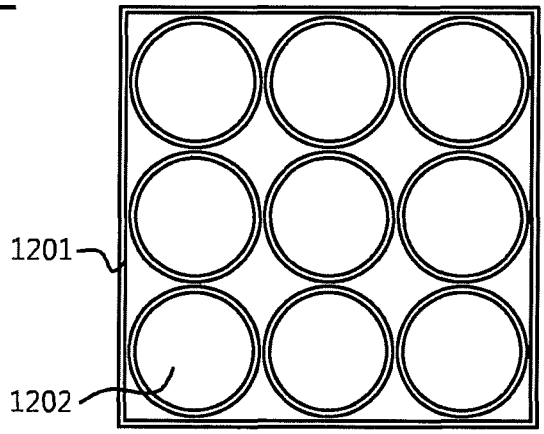
FIG. 12 shows a cross section of a second example heat exchanger.
Figure 13:
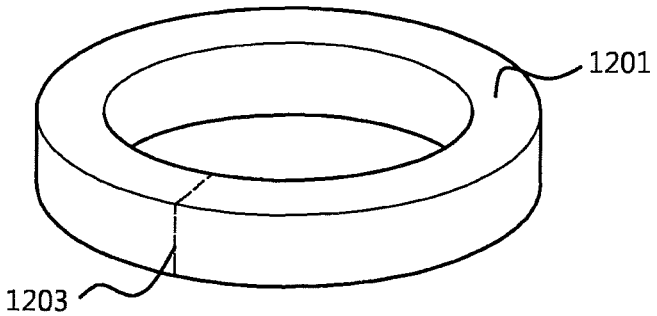
FIG. 13 shows a perspective view of the second example heat exchanger.

FIG. 12 and FIG. 13 show another embodiment of a toroid vessel 1201 with tubes 1202. FIG. 12 shows a cross section indicated in FIG. 13 at numeral 1203. The tube windings are arranged in a rectangular grid and the shape of the vessel itself is a toroid generated by rotating a rectangular shape. Inlets and outlets are omitted in the drawing for simplicity. These are inlets and outlets may be similar to the embodiments of FIGS. 1 to 10.

Figure 14:
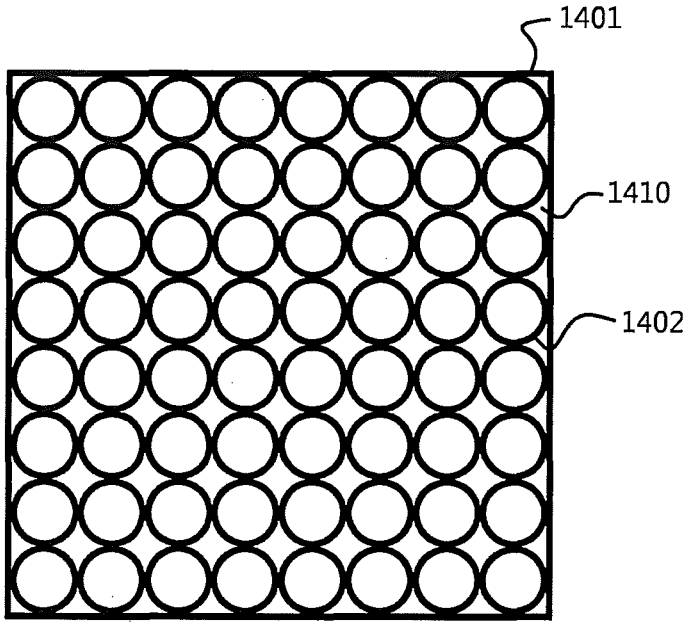
FIG. 14 shows a cross section of a third example heat exchanger.
Figure 15:
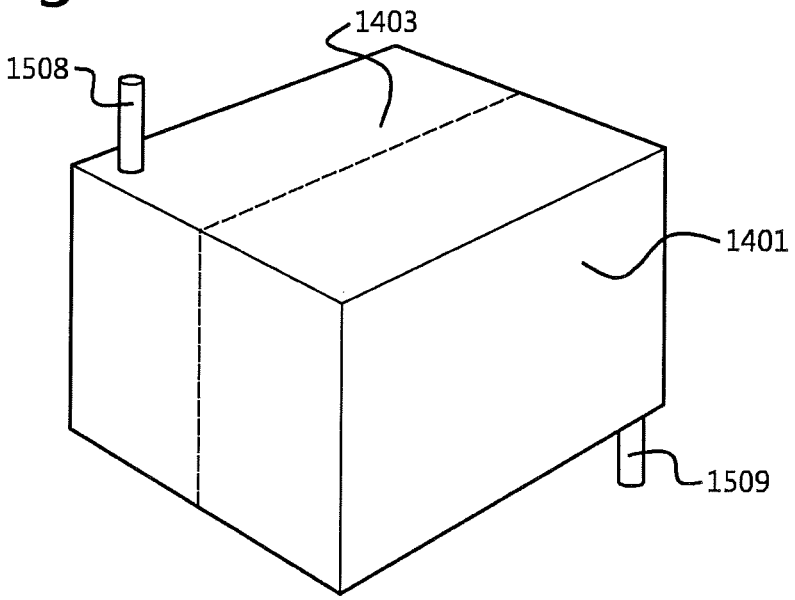
FIG. 15 shows a perspective view of the third example heat exchanger.
Figure 16:
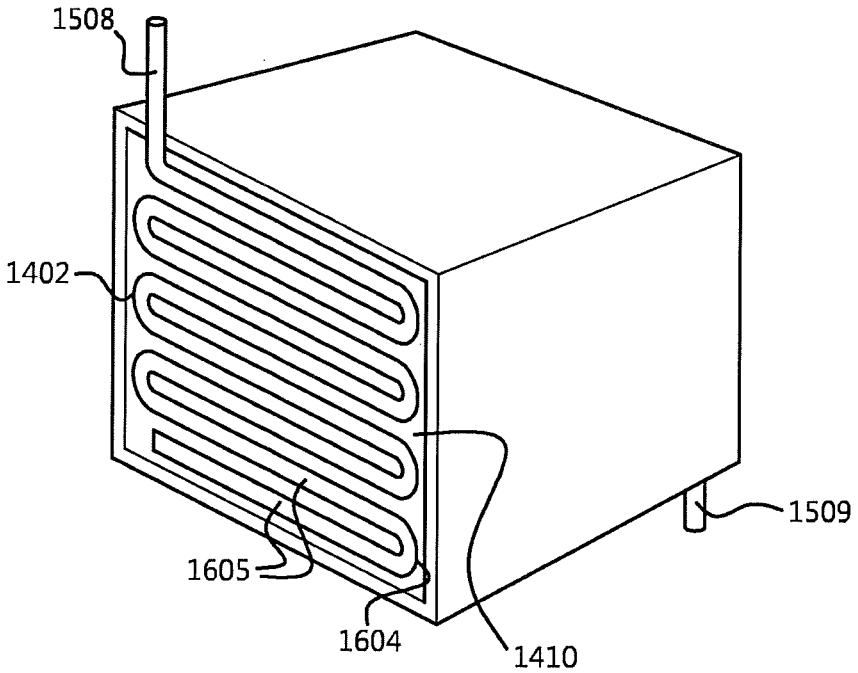
FIG. 16 shows a partially worked open perspective view of the third example heat exchanger.

FIG. 14, FIG. 15, and FIG. 16 show another embodiment of a cubic vessel 1401 with tubes 1402. FIG. 15 shows a perspective view. FIG. 16 shows a partially worked open perspective view. FIG. 14 shows a cross section indicated in FIG. 15 at numeral 1403. Several tube segments 1605 are connected by means of a U piece 1604. The tube segments 1605 are arranged in a rectangular grid (square tiling) as shown in cross section FIG. 14. The tube has tube portion 1402 inside the chamber 1410, and the tube extends out of the chamber at portions 1508 and 1509. It is noted that in an alternative embodiment using U pieces in a similar way, the tube segments 1605 could have been arranged in a hexagonal tiling instead of square tiling. The inlet 6 and outlet 7 for refrigerant have not been drawn. These may be located at different locations, as described above in respect of FIGS. 1 to 10. For example, the inlet for refrigerant may be located at the bottom of the vessel 1401 and the outlet for refrigerant may be located at the top of the vessel 1401. However, other locations are also possible.

FIG. 9 shows the cross section 303 of FIG. 3. The principles explained with respect to FIG. 9 may also be applied to alternatively shaped vessels, such as the ones shown in FIGS. 13 to 16. The at least one tube portion 10 inside the chamber 302 has an outer diameter. If the diameter varies along the tube portion, or if a plurality of tube portions have different diameters, the at least one tube portion still has an average tube diameter d.

In the chamber 302, some of the space is occupied by the at least one tube portion 10. Optionally, some space may be occupied by other objects. The remaining space 902 can be occupied by a fluid (liquid, gas). In use as an evaporator, this space is occupied by a refrigerant (partially in liquid phase, and partially in gaseous phase). The volume of this remaining space to be occupied by a refrigerant can be determined, for example by calculation. Alternatively, to determine the volume of the space, the space may be temporarily filled with a liquid, and the amount of liquid needed to fill the space can be used to determine the volume of the space.

The total area A of the outside surface 901 of the at least one tube portion can be determined by calculation. For example, if the radius of the tube is r and the length of the tube portion is L, then the area A can be estimated as $A=2\pi rL$. This way, the total area of the outside surface that is in contact (for heat exchange) with the refrigerant in the space is determined. The (average) diameter d of the tube is two times the radius r, i.e. $d=2r$.

The volume V can be expressed in cubic millimeters ($mm^3$), the area A can be expressed in square millimeters ($mm^2$), and the diameter d can be expressed in millimeters (mm).

The volume V of the space thus defined, divided by a product of the area A of the outside surface of the at least one tube portion, and the average diameter d of the at least one tube portion, results in a number N as follows:

$$N = \frac{V}{A \cdot d},$$

with $A=2\pi(d/2)L$.

Since for a tube portion of circular cross section, the cross sectional area is equal to $\pi d^2/4$, this can be expressed as $N=V/(4V_t)$, wherein $V_t$ is the volume defined by the tube portion, $V_t=\pi d^2L/4=Ad/4$.

In certain preferred embodiments this number N is smaller than or equal to 0.15, i.e. $V/Vt \leq 0.6$. In certain, more preferred, embodiments this number is smaller than or equal to 0.12, i.e. $V/Vt \leq 0.48$. In certain, more preferred, embodiments this number is smaller than or equal to 0.10, i.e. $V/Vt \leq 0.4$. In certain, more preferred embodiments this number is smaller than or equal to 0.09, i.e. $V/Vt \leq 0.36$. In certain, more preferred, embodiments this number is smaller than or equal to 0.08, i.e. $V/Vt \leq 0.32$. In certain, more preferred, embodiments this number is smaller than or equal to 0.05, i.e. $V/Vt \leq 0.2$.

In all cases, the refrigerant volume V is relatively small compared with the volume $V_t$ of the tube portion, i.e. $V/Vt \leq 0.6$.

For example, the constraint regarding this number may be applied for any given tube diameter, to determine the amount of space between adjacent tube segments.

In addition hereto, in certain embodiments, the number is greater than 0.03, i.e. $V/Vt > 0.12$.

As illustrated, the at least one tube portion inside the chamber 302 comprises a plurality of adjacent tube segments 301. The adjacent tube segments can be spaced with respect to each other with a space s in between a pair of adjacent tube segments of at most 2 millimeters, preferably at most 1 millimeter, preferably at most 0.5 millimeter. This constraint may replace or supplement the above-mentioned constraint regarding the maximum of the number obtained by dividing the volume by the product of the area and the average diameter. This constraint may be applied to large or small diameter tubes.

In a particular example, the diameter of the tube portion(s) may be e.g. 40 mm or larger, and the adjacent tube segments can be spaced with respect to each other with a space in between a pair of adjacent tube segments of at most 2 millimeters, preferably at most 1 millimeter, preferably at most 0.5 millimeter.

Figure 11:
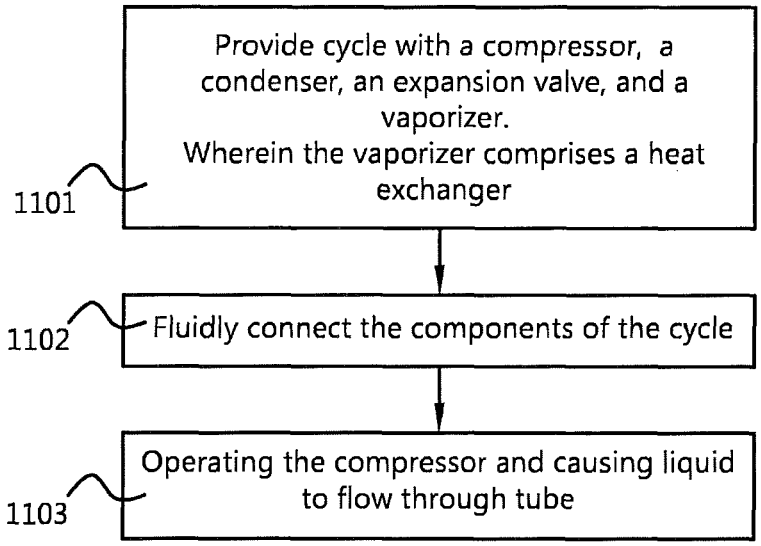
FIG. 11 is a flowchart of a method of cooling a liquid.

FIG. 11 illustrates a method of cooling a liquid. In step 1101, the method starts with providing a cycle comprising a compressor 1, a condenser 2, an expansion valve 3, 4, and an evaporator, wherein the evaporator comprises a heat exchanger 14, and the heat exchanger 14 comprises a vessel 5 for containing a refrigerant. In step 1102, the compressor condenser expansion valve, and evaporator are connected in fluid communication to form a refrigeration cycle, wherein the evaporator comprises a heat exchanger, and the heat exchanger comprises a vessel, the vessel having a chamber bounded by a surface of a vessel wall, the vessel comprising an inlet and an outlet for transport of a refrigerant into and out of the chamber, wherein providing a compressor, a condenser, an expansion valve, and an evaporator in fluid communication comprises fluidly connecting the inlet of the vessel to the expansion valve and fluidly connecting the outlet of the vessel to the compressor. At least one tube of which at least one tube portion is inside the chamber is also provided, wherein a first end of the tube portion is fixed to a first orifice of the vessel and a second end of the tube portion is fixed to a second orifice of the vessel to enable fluid communication into and/or out of the tube portion through the first orifice and the second orifice, wherein said at least one tube portion has an average diameter. The chamber is provided with a space for a fluid, said space having a volume. The at least one tube portion has an outer surface in contact with the space for the fluid, said surface having an area. The volume divided by a product of the area and the average diameter is smaller than or equal to 0.2. The method further comprises in step 1103 operating the compressor to circulate a refrigerant through the refrigeration cycle including the space for the fluid, and causing a further fluid to flow through the tube portion.

In certain examples, the at least one tube portion inside the chamber is arranged in a plurality of adjacent tube segments, wherein adjacent tube segments have facing outside surfaces, wherein in between a pair of adjacent tube segments there is a space for a fluid, wherein the space in between the tube segments of the at least one tube portion has a volume. The at least one tube portion has an outer surface in contact with the space for the fluid, said outer surface having an area, and the volume divided by a product of the area and the average diameter of the at least one tube portion is smaller than 0.15, 0.12, 0.10, 0.09, or 0.08.

An example provides a heat exchanger comprising:

a vessel for containing a refrigerant, the vessel having a chamber bounded by a surface of a vessel wall, the vessel comprising an inlet and an outlet for transport of refrigerant into and out of the chamber through the vessel wall;

at least one tube of which at least one tube portion is inside the chamber, wherein a first end of the tube portion is fixed to a first orifice of the vessel wall and a second end of the tube portion is fixed to a second orifice of the vessel wall to enable fluid communication into and/or out of the tube portion through the first orifice and the second orifice;

wherein the chamber of the heat exchanger presents a hole, and wherein the tube portion is arranged in a plurality of windings around a wall portion of said vessel wall, which wall portion defines said hole;

wherein the windings are arranged in a hexagonal tiling and form a bundle, with a space between each pair of adjacent windings;

wherein the surface of the vessel wall is arranged around the bundle with a space between the vessel wall and each of the windings that are configured to be immersed in liquid refrigerant during heat exchange and are at an outside of the bundle.

The arrangement of the tube windings in a hexagonal tiling cause a relatively large amount of space occupied by the tube and relatively small amount of space in the chamber outside the tube. The latter space is to be occupied by the liquid refrigerant; since the space for the liquid refrigerant is reduced, the total amount of refrigerant necessary to maintain a refrigeration cycle is reduced. The design allows a compact design while allowing the refrigerant to exchange heat with the inside of the tube and allows the gaseous refrigerant to escape upwardly.

The surface of the vessel wall may be arranged with said space between the vessel wall and all of the windings that are at the outside of the bundle. This allows for a compact design of the heat exchanger.

The surface can be a closed surface. This allows for a compact and/or rugged design.

The hexagonally tiled windings may be arranged in rows, each row consisting of a number of windings, wherein the number of windings in any one row differs with respect to each adjacent row by one winding, wherein when considering the successive rows in turn, the number of windings is either monotonically increasing or decreasing, or first increases and then decreases. This allows a compact bundle of windings.

The chamber may have a shape of a toroid generated by a hexagon or a quadrilateral. Such a shape of the chamber may compactly encapsulate the tubing. It is noted that the edges of the hexagon or quadrilateral may be slightly rounded outwardly, for example to provide better resistance to high pressures inside the chamber.

The hexagon or quadrilateral has rounded corners following a contour of the tube (see for example near numeral 402 in FIG. 4). This further reduces the amount of refrigerant to be supplied inside the chamber.

The distance between a central axis of the tube in two adjacent windings multiplied by one half of the square root of three may be smaller than an outer diameter of the tube. This further reduces the amount of refrigerant.

The distance from the inner surface to a circumference of a portion of the tube adjacent to the inner surface may be equal to a distance between the circumference of a first winding of the tube to the circumference of a second winding of the tube, wherein the second winding is adjacent to the first winding. This further reduces the amount of refrigerant.

The tube may have an inner diameter of 7 mm, and the distance between each pair of adjacent windings may be between 0.2 and 0.8 mm. This allows a compact design while allowing the refrigerant to exchange heat with the inside of the tube and allows the gaseous refrigerant to escape upwardly.

The chamber may comprise propane as the refrigerant. This is a suitable refrigerant which is used in small quantities. The small size of the portion of the chamber that is not occupied by the tubes helps to reduce the amount of refrigerant (e.g. propane) that is needed.

The outlet may be arranged above a liquid level of the refrigerant. This prevents the refrigerant to escape from the chamber and move towards the compressor in liquid form.

The vessel wall may be enclosed in a toroid shaped body. This allows to strengthen the design in several different ways.

For example, the toroid shaped body may be configured to reinforce the vessel wall in view of a pressure difference between the chamber and an environment of the heat exchanger. This allows the vessel wall to be of less strong a material. For example, a rigid filling material may be fitted in between the vessel wall and the toroid shaped body, wherein the toroid shaped body and the filling material keep the vessel wall in place.

Another example is to provide a cooling system for cooling a liquid, comprising a cycle comprising a compressor, a condenser, an expansion valve or expansion device, and a heat exchanger set forth above, in fluid communication, wherein the inlet is fluidly connected to the expansion valve and the outlet is fluidly connected to the compressor. This allows the heat exchanger to function as an evaporator in the refrigeration cycle.

Another example is to provide a method of cooling a liquid, the method comprising providing a cycle comprising a compressor, a condenser, an expansion valve or expansion device, and an evaporator, in fluid communication, wherein the evaporator comprises a heat exchanger, and the heat exchanger comprises:

a vessel for containing a refrigerant, the vessel having a chamber bounded by a surface of a vessel wall, the vessel comprising an inlet and an outlet for transport of refrigerant into and out of the chamber through the vessel wall, at least one tube of which at least one tube portion is inside the chamber, wherein a first end of the tube portion is fixed to a first orifice of the vessel wall and a second end of the tube portion is fixed to a second orifice of the vessel wall to enable fluid communication into and/or out of the tube portion through the first orifice and the second orifice, wherein the chamber of the heat exchanger presents a hole, and wherein the tube portion is arranged in a plurality of windings around a wall portion of said vessel wall, which wall portion defines said hole, wherein the windings are arranged in a hexagonal tiling and form a bundle, with a space between each pair of adjacent windings, wherein the surface of the vessel wall is arranged around the bundle, with a space between the vessel wall and each of the windings that are configured to be immersed in liquid refrigerant during heat exchange and are at an outside of the bundle;

fluidly connecting the inlet to the expansion valve and fluidly connecting the outlet to the compressor; and operating the compressor to circulate a refrigerant through the refrigeration cycle, and causing a liquid to flow through the tube.

The examples and embodiments described herein serve to illustrate rather than limit the invention. The person skilled in the art will be able to design alternative embodiments without departing from the scope of the claims. Reference signs placed in parentheses in the claims shall not be interpreted to limit the scope of the claims. Items described as separate entities in the claims or the description may be implemented as a single hardware or software item combining the features of the items described.

The invention claimed is:

1. A heat exchanger comprising:

a vessel for containing a refrigerant, the vessel having a vessel wall and a chamber bounded by a surface of the vessel wall, the vessel comprising an inlet and an outlet for transport of a refrigerant into and out of the chamber;

at least one tube having at least one tube portion inside the chamber, a first end of the at least one tube portion is fixed to a first orifice of the vessel and a second end of the at least one tube portion is fixed to a second orifice of the vessel to enable fluid communication at least one of into or out of the at least one tube portion through the first orifice and the second orifice, said at least one tube portion has an average diameter;

the chamber comprises a space for the refrigerant, said space having a volume, the at least one tube portion has an outer surface in contact with the space for the refrigerant, said surface having an area; and the volume divided by a product of the area and the average diameter is smaller than or equal to 0.15.

2. The heat exchanger of claim 1, wherein the volume divided by the product of the area and the average diameter is smaller than or equal to 0.12.

3. The heat exchanger of claim 2, wherein the volume divided by the product of the area and the average diameter is smaller than or equal to 0.10.

4. The heat exchanger of claim 1, wherein the at least one tube portion inside the chamber comprises a plurality of adjacent tube segments, and adjacent ones of the tube segments are spaced apart with respect to each other with a space of at most 2 millimeters.

5. The heat exchanger of claim 1, wherein the at least one tube portion inside the chamber comprises a plurality of adjacent tube segments, said adjacent tube segments, in a cross section of the chamber, form a hexagonal tiling arrangement or are arranged in a rectangular grid.

6. The heat exchanger of claim 5, wherein the plurality of adjacent tube segments in the hexagonal tiling arrangement are arranged in rows, each said row including a number of windings, the number of windings in any one of the rows differs with respect to each adjacent one of the rows by one winding, and in successive ones of the rows, the number of windings is either monotonically increasing or decreasing, or first increases and then decreases.

7. The heat exchanger of claim 1, wherein the at least one tube portion is arranged in a plurality of windings around a wall portion of said vessel wall and around a region external to the chamber.

8. The heat exchanger of claim 7, wherein the chamber has a shape of a toroid generated by a hexagon or a quadrilateral.

9. The heat exchanger of claim 8, wherein the hexagon or the quadrilateral has rounded corners that follow a contour of the tube.

10. The heat exchanger of claim 1, wherein the at least one tube portion is arranged in a plurality of windings, and a distance between a central axis of the tube and two adjacent ones of the windings multiplied by one half of the square root of three is smaller than an outer diameter of the tube.

11. The heat exchanger of claim 1, wherein a distance from the surface of the vessel wall to a circumference of a first segment of the at least one tube portion adjacent to the surface is substantially equal to a distance between said circumference and a circumference of a second segment of the at least one tube portion adjacent to the first segment.

12. The heat exchanger of claim 1, further comprising propane as the refrigerant in the space.

13. The heat exchanger of claim 1, wherein the vessel further comprises a body and the vessel wall is enclosed in the body, the body is configured to reinforce the vessel wall in view of a pressure difference between the chamber and an environment of the heat exchanger.

14. The heat exchanger of claim 13, wherein the body is a toroid shaped body.

15. The heat exchanger of claim 1, further comprising a compressor, a condenser, and an expansion valve, the compressor, the condenser, the expansion valve, and the heat exchanger are in fluid communication with one another, with the inlet fluidly connected to the expansion valve and the outlet fluidly connected to the compressor.

16. A method of cooling a fluid, comprising providing a compressor, a condenser, an expansion valve, and an evaporator, in fluid communication to form a refrigeration cycle, the evaporator comprising a heat exchanger that includes a vessel having a vessel wall that defines a chamber bounded by a surface of the vessel wall, the vessel comprising an inlet and an outlet for transport of a refrigerant into and out of the chamber, and the providing step including fluidly connecting the inlet of the vessel to the expansion valve and fluidly connecting the outlet of the vessel to the compressor;

providing at least one tube having at least one tube portion inside the chamber, a first end of the at least one tube portion is fixed to a first orifice of the vessel and a second end of the at least one tube portion is fixed to a second orifice of the vessel to enable fluid communication at least one of into or out of the at least one tube portion through the first orifice and the second orifice, said at least one tube portion has an average diameter;

providing the chamber with a space for the refrigerant, said space having a volume, the at least one tube portion has an outer surface in contact with the space for the refrigerant, said surface having an area;

the volume divided by a product of the area and the average diameter is smaller than or equal to 0.15;

the method further comprising:

operating the compressor to circulate a refrigerant through the refrigeration cycle including the space for the refrigerant, and causing a further fluid to flow through the at least one tube portion.

* * * * *